US008079575B2

(12) United States Patent
Novotny et al.

(10) Patent No.: US 8,079,575 B2
(45) Date of Patent: Dec. 20, 2011

(54) STEAM TUBE CONNECTION FOR STEAM HUMIDIFIER

(75) Inventors: Josef Novotny, Kucina (CZ); Wayne R. Anderson, Eden Prairie, MN (US); Brad Alan Terlson, Maple Grove, MN (US); Steve L. Wolff, Hamel, MN (US)

(73) Assignee: Honeywell International, Morristown, NJ (US)

( * ) Notice: Subject to any disclaimer, the term of this patent is extended or adjusted under 35 U.S.C. 154(b) by 0 days.

(21) Appl. No.: 12/685,537

(22) Filed: Jan. 11, 2010

(65) Prior Publication Data

US 2010/0102462 A1 Apr. 29, 2010

Related U.S. Application Data

(63) Continuation of application No. 11/780,180, filed on Jul. 19, 2007, now Pat. No. 7,673,859, which is a continuation-in-part of application No. 11/535,390, filed on Sep. 26, 2006, now Pat. No. 7,673,858.

(51) Int. Cl.
*B01F 3/04* (2006.01)

(52) U.S. Cl. ..... 261/118; 261/DIG. 15

(58) Field of Classification Search ..... 261/115, 261/118, 141, 142, DIG. 10, DIG. 15, DIG. 65, 261/DIG. 76

See application file for complete search history.

(56) References Cited

U.S. PATENT DOCUMENTS

| | | | |
|---|---|---|---|
| 3,319,046 | A | 5/1967 | Katzman et al. |
| 3,610,879 | A | 10/1971 | Katzman et al. |
| 3,659,078 | A | 4/1972 | Rudstrom |
| 3,689,037 | A | 9/1972 | Payne |
| 3,714,392 | A | 1/1973 | Katzman et al. |
| 3,855,371 | A | 12/1974 | Morrow et al. |
| 3,898,976 | A | 8/1975 | Coffman, Jr. |
| 4,132,883 | A | 1/1979 | Grime |
| 4,211,735 | A | 7/1980 | Berlin |
| 4,384,873 | A | 5/1983 | Herr |
| 4,463,248 | A | 7/1984 | Katzman et al. |
| 5,516,466 | A | 5/1996 | Sclesch et al. |
| 5,543,090 | A | 8/1996 | Morton et al. |
| 5,942,163 | A | 8/1999 | Robinson et al. |
| 6,260,514 | B1 | 7/2001 | Ehling et al. |

(Continued)

OTHER PUBLICATIONS

Color Picture of Steam Humidifier Nozzle, believed to be General Aire Elite Model, Sep. 2006.

(Continued)

*Primary Examiner* — Charles Bushey

(74) *Attorney, Agent, or Firm* — Seager, Tufte & Wickhem LLC

(57) ABSTRACT

A twist locking connector for a steam humidifier. The steam humidifier includes a tank for heating water to generate steam and a steam tube receiver structure in fluid communication with the tank. The steam tube receiver structure has an opening configured to receive a steam tube, where the opening has a plurality of ramp structures about the opening on a side facing the tank. The steam humidifier also includes a steam tube for transmitting steam from the tank to a duct, the steam tube having a plurality of locking tabs adjacent to an end and a flange adjacent to, but separated by a distance from, the locking tabs. The steam tube is assembled to the steam tube receiver by inserting the steam tube through the opening in the steam tube receiver structure and rotating the steam tube to cause the locking tabs to engage with the ramp structures.

19 Claims, 10 Drawing Sheets

U.S. PATENT DOCUMENTS

| | | | | |
|---|---|---|---|---|
| 6,397,001 | B1 | 5/2002 | Mantagnino et al. | |
| 6,398,196 | B1 | 6/2002 | Light et al. | |
| 6,488,219 | B1 | 12/2002 | Herr | |
| 6,560,408 | B2 | 5/2003 | Glucksman et al. | |
| 7,068,924 | B2 | 6/2006 | Watanabe et al. | |
| 7,673,855 | B2 * | 3/2010 | Anderson et al. | 261/49 |
| 7,673,858 | B2 * | 3/2010 | Anderson et al. | 261/118 |
| 7,673,859 | B2 * | 3/2010 | Novotny et al. | 261/118 |
| 7,766,310 | B2 * | 8/2010 | Wolff et al. | 261/72.1 |
| 2005/0150491 | A1 | 7/2005 | Chen | |

OTHER PUBLICATIONS http://www.generalaire.com/cimages/New_Elite_Steam_Humidifiers.pdf., "Elite Steam Residential Steam Humidifiers User Manual," GeneralAire, 2007.

http://www.ewccontrols.com/acrobat/steam/s2000.pdf, "Installation Instructions and Owners Manual," EWC Controls Inc., 2003.

http://www.skuttle.com/OM/Skuttle60manual06.pdf, "Installation Instructions for Model 60-Series High Capacity Steam Humidifiers," Skuttle Indoor Air Quality Products, 2006.

http://www.skuttle.com/f601.html, "Model F60-1," Skuttle Indoor Air Quality Products, 2007.

http://www.ewccontrols.com/steam_humidifier.htm, "Autoflo Models S2000 & S2020," EWC Controls Inc., Jan. 20, 2006.

Aprilaire, "Steam Humidifier Models 1150 and 1160," 2007.

Honeywell Automation and Control Solutions, "The Best Humdifier Available," 2006.

* cited by examiner

STEAM TUBE CONNECTION FOR STEAM HUMIDIFIER

RELATED APPLICATIONS

This application is a continuation of U.S. patent application Ser. No. 11/780,180, filed Jul. 19, 2007, titled "Twist Locking Connection for Steam Humidifier", now U.S. Pat. No. 7,673,859, which is a continuation-in-part of U.S. patent application Ser. No. 11/535,390, filed Sept. 26, 2006, titled "Low Pressure Steam Humidifier System", now U.S. Pat. No. 7,673,858, both of which are incorporated herein by reference.

FIELD OF THE INVENTION

The invention relates to steam humidifiers, and more particularly, to steam tubes for low pressure steam humidifiers.

BACKGROUND OF THE INVENTION

The interior spaces of buildings are often at a lower than desired level of humidity. This situation occurs commonly in arid climates and during the heating season in cold climates. There are also instances in which special requirements exist for the humidity of interior spaces, such as in an art gallery or where other delicate items are stored, where it is desired that the interior humidity levels be increased above naturally occurring levels. Therefore, humidifier systems are often installed in buildings to increase the humidity of an interior space.

Humidification systems may take the form of free-standing units located within individual rooms of a building. More preferably, humidification systems are used with building heating, ventilation, and air conditioning (HVAC) systems to increase the humidity of air within ducts that is being supplied to interior building spaces. In this way, humidity can be added to the air stream at a centralized location, as opposed to having multiple devices that increase humidity at multiple points within the building interior. Additionally, because the air within ducts may be warmer than the interior space air during a heating cycle, the additional air temperature can help prevent water vapor from condensing in the vicinity of the humidifier, such as on the inside of the duct.

An issue associated with humidification system is that they should only discharge water vapor into a duct and not liquid water. Liquid water within a duct can create a number of serious problems. For example, liquid water that remains stagnant within a duct can promote the growth of mold or organisms that can release harmful substances into the air flow, potentially causing unhealthy conditions in the building. Liquid water can also cause rusting of a duct which can lead to duct failure, and can create leaks from the duct to the building interior spaces which are unsightly, can cause a slipping hazard, and can lead to water damage to the structure.

One known humidification method involves direct steam injection into an air duct of a building. This approach is most commonly used in commercial buildings where a steam boiler is present to provide a ready supply of pressurized steam. Steam humidification has the advantage of having a relatively low risk of liquid moisture entering a duct or other building space. However, pressurized steam injection systems are associated with a risk of explosion of the steam pressure vessels, as well as a risk of possibly burning nearby people, both of which are very serious safety concerns. In residential applications, there are usually no readily available sources of pressurized steam. An open bath humidifier system may be used, however these are difficult to install because they require a large hole in the duct and can only be used with horizontal or upflow ducts. Alternatively, a residential application may use direct steam injection, but this requires a separate unit to generate pressurized steam and this separate unit is costly. Moreover, the system would suffer from the same disadvantages as are present in commercial direct steam injection systems.

One type of humidifier that is used in residential applications that has the advantages of steam humidification without the need for a separate source of pressurized steam is a tank heater type humidifier, also called a low pressure steam humidifier. In this type of humidifier, a heat input is made to a tank of water causing the water to boil and steam to be generated. The heat input may be any of a number of different sources, however, commonly an electrical heating element is used. Improved humidification systems are desired. In particular, improved constructions of tank heater type humidifiers are needed.

SUMMARY OF THE INVENTION

An aspect of the invention relates to a steam humidifier, and a twist locking connection for a steam humidifier. The steam humidifier includes a tank for heating water to generate steam and a steam tube receiver structure in fluid communication with the tank. The steam tube receiver structure has an opening configured to receive a steam tube, where the opening has one or more ramp structures about the opening on a side facing the tank. The steam humidifier also includes a steam tube for transmitting steam from the tank to a duct, the steam tube having one or more locking tabs adjacent to an end and a flange adjacent to, but separated by a distance from, the locking tabs. The steam tube is assembled to the steam tube receiver by inserting the steam tube through the opening in the steam tube receiver structure and rotating the steam tube to cause the one or more locking tabs to engage with the one or more ramp structures.

Another aspect of the invention also relates to a steam humidifier. The steam humidifier includes a tank for containing water, where the tank includes a heater for heating the water to produce steam. The steam humidifier further includes a steam tube in fluid communication with the tank for transmitting steam from the tank to a duct, and this steam tube has a proximal end that receives steam from the tank and a distal end that discharges steam to the duct, a flange located nearer to the proximal end than to the distal end of the steam tube, and a cylindrical outer surface between the flange and the proximal end of the steam tube. The cylindrical outer surface has a pair of locking tabs that project from the cylindrical outer surface. The steam humidifier also includes a steam tube receiver structure that is configured to receive the steam tube and to provide for fluid communication between the tank and the steam tube. The steam tube receiver structure has a cylindrical cavity with a face that defines a bottom of the cylindrical cavity, where the face has a first side facing away from the tank and a second side that is an opposite surface from the first side and that faces into the tank. The steam tube receiver structure further includes a steam tube opening in the face having a generally round opening portion that is configured to receive the cylindrical outer surface of the steam tube and a pair of notch openings that are configured to receive the locking tabs of the steam tube. In addition, the steam tube receiver structure includes ramp structures projecting from the second side of the face and in a generally semi-circular configuration about the generally round opening portion, the ramp structures defining an increasing distance from the first side of the face to the surface of the ramp structures with increasing angular distance from each of the notch openings. The steam tube is configured to be assembled to the steam tube receiver structure by inserting the cylindrical outer surface of the steam tube through the generally round opening portion and by inserting the pair of locking tabs of the steam tube through the pair of notch openings of the steam tube opening. The steam tube is further configured to be retained within the steam tube opening by rotating the steam tube to cause the locking tabs of the steam tube to travel along the ramp structures on the underside of the face and to pull the steam tube flange toward the first side of the face of the steam tube receiving structure.

Another aspect of the invention relates to a method of assembling a steam humidifier. The method includes molding a steam tube in one molding step, where the steam tube has one or more locking tabs, and molding a steam tube receiver in one molding step, where the steam tube receiver has an opening configured to receive the steam tube. This opening in the steam tube receiver has one or more ramp structures about the opening on a side facing the tank and one or more notch openings configured to receive the locking tabs of the steam tube. The method further includes grasping the steam tube with a hand, orienting the one or more locking tabs of the steam tube with the one or more notch openings of the steam tube receiver structure and inserting the one or more locking tabs through the one or more notch openings, and twisting the steam tube to cause the one or more locking tabs to engage with the steam tube receiver structure and to hold the steam tube to the steam tube receiver structure.

Yet another aspect of the invention relates to a steam humidifier. The steam humidifier includes a tank for heating water to generate steam and a steam tube for transmitting steam from the tank to a duct. The steam tube has one or more locking tabs that are adjacent to an end and a flange that is adjacent to, but separated by a distance from, the one or more locking tabs. The steam humidifier further includes a steam tube receiver structure that is in fluid communication with the tank, where the steam tube receiver structure has a face with an opening that is configured to receive the steam tube. This opening includes one or more notch openings for receiving the one or more locking tabs of the steam tube. The steam tube is assembled to the steam tube receiver by inserting the steam tube through the opening in the steam tube receiver structure and the one or more locking tabs through the one or more notch openings, until the flange contacts the face, and rotating the steam tube.

The invention may be more completely understood by considering the detailed description of various embodiments of the invention that follows in connection with the accompanying drawings.

Figure 1:
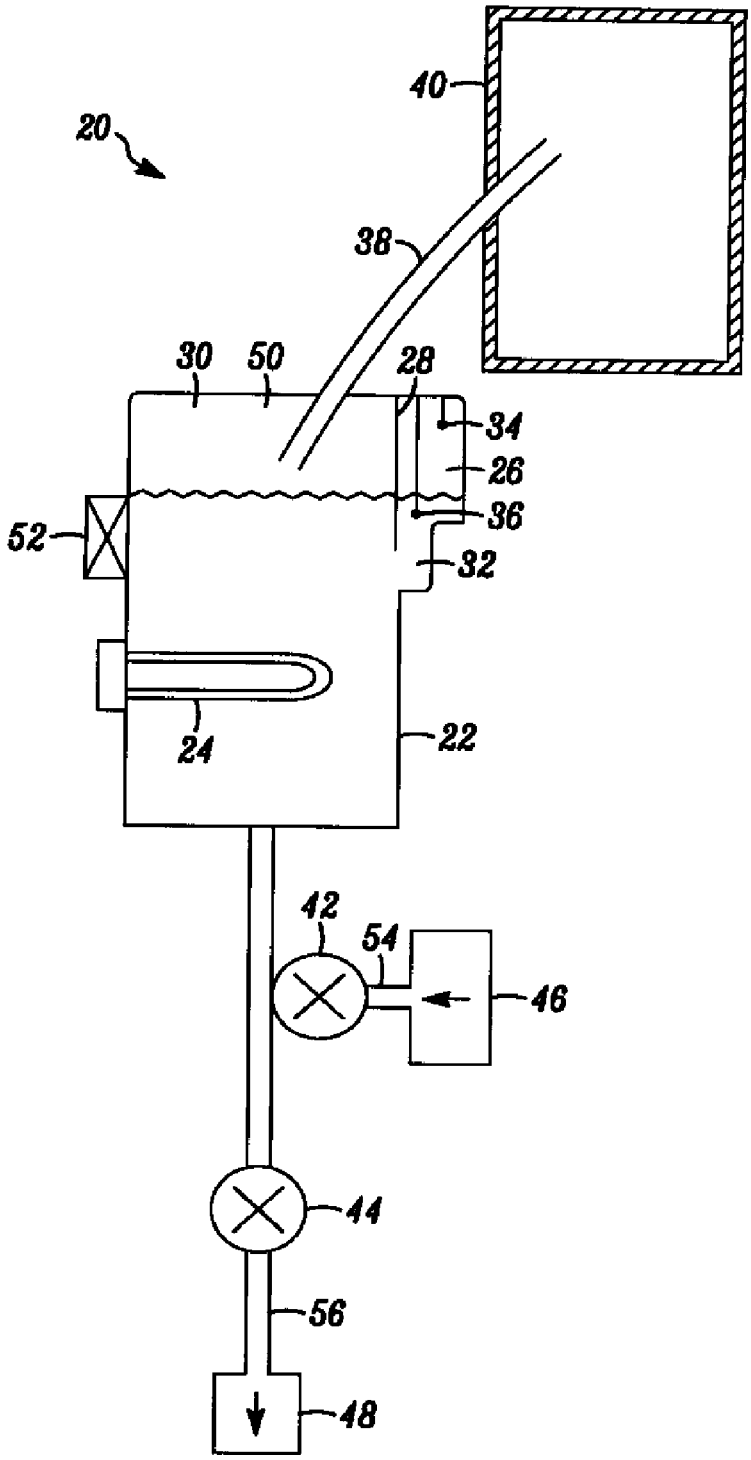
FIG. 1 is a cross-sectional schematic view of a tank heater type steam humidifier.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

An embodiment of a tank heater type humidifier is depicted in FIG. 1. Humidifier includes a tank 22 configured to retain a volume of liquid water. Tank 22 is generally constructed out of material that is sufficiently resistant to high temperatures, such as the temperature of boiling water. Examples of suitable materials for tank 22 are temperature resistant plastics, an example of which is a thermoplastic resin such as a polyphenylene ether/polystyrene blend, and stainless steel. A heating coil 24 is also provided to heat water within tank 22. Heating coil 24 is generally an electric heating coil that generates heat when an electric current is passed through a resistive material. However, other types of heating coils 24 are usable. For example, heating coil 24 could pass a heated material such as a heated liquid through a tube that allows heat to transfer to the liquid in the tank 22. Furthermore, a heater may be substituted for heating coil 24, where a heater is of a conventional liquid heating design, such as a propane or natural gas liquid heater or a fuel oil burner.

Tank 22 is shown in FIG. 1 as having an isolated chamber 26 that is separated from a main chamber 30 of tank 22 by baffle 28. Isolated chamber 26 is in fluid communication with main chamber 30 by way of opening 32 which allows liquid from main chamber 30 to flow into isolated chamber 26 and to reach the same fluid level as in main chamber 30. Isolated chamber 26 tends to be insulated from ripples, bubbles, and other fluctuations of the water level in main chamber 30. FIG. 1 also shows that a high level water sensor 34 and a low level water sensor 36 are present within isolated chamber 26. Sensor 36 detects the presence of water at a first level and sensor 34 detects the presence of water at a second level, where the first level is lower than the second level. Each of sensors 34, 36 is configured to detect the presence of water at the particular sensor. Sensors 34, 36 may be a current-detection type of sensor, where a source of current such as alternating current is applied at a point in the tank that is below both sensors 34, 36 and where sensors 34, 36 are configured to detect the presence of current which indicates a current path from the source of current, through the water, to sensors 34, 36. Alternatively, high level and low level sensors 34, 36 may be replaced by a single water level sensor that produces a signal representative of the level of the water in tank 22, such as a float sensor. Humidifier 20 further includes a steam tube 38 that projects from main tank chamber 30 to the interior of an air duct 40 and that provides a fluid connection for the flow of steam from main tank chamber 30 to the interior of air duct 40. Although in some embodiments steam tube 38 is tubular, it can also readily have any desired cross-sectional profile, such as square, rectangular, oval, triangular, etc. Humidifier 20 includes a fill valve 42 and a drain valve 44. Fill valve 42 is in fluid communication through conduit 54 with a water supply 46, such as a municipal water supply system or a well pump system. Drain valve 44 is in fluid communication through a conduit 56 with a water receiving system 48, such as a municipal water treatment system, a septic system, or a drain field. Humidifier 20 further includes a controller 52 that is in communication with water level sensors 34, 36 and has the ability to control the fill and drain valves 42, 44.

Figure 2:
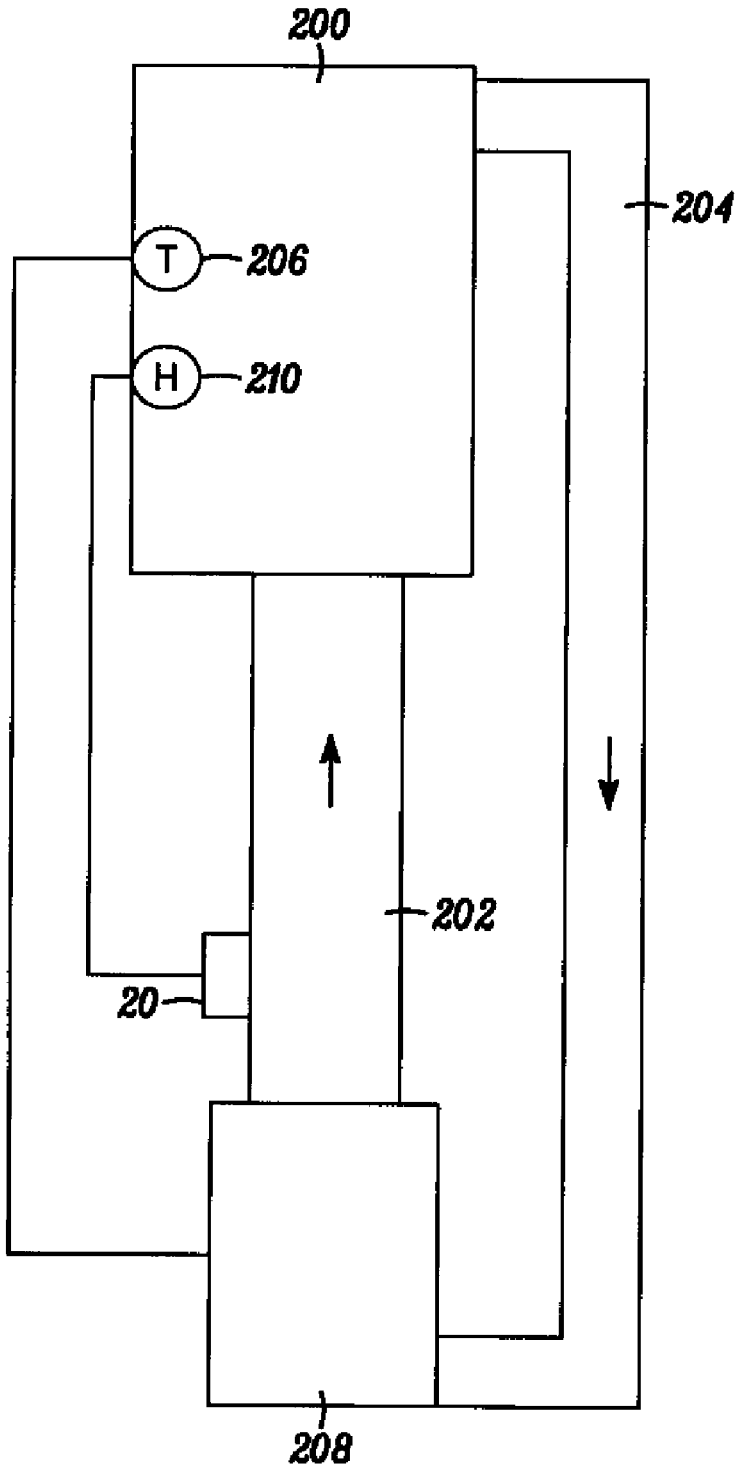
FIG. 2 is a schematic representation of a HVAC system having a humidifier.

A typical heating, ventilation, and air conditioning (HVAC) installation that includes a humidifier is depicted in FIG. 2. Conditioned space 200 of a building is configured to receive conditioned air from supply duct 202 and to provide for return air flow through return duct 204. Conditioned space 200 includes at least one thermostat 206 that is in communication with conditioning device 208. Conditioning device 208 may be a furnace, an air conditioner, a heat exchanger, or a combination thereof, that is configured to condition return air from return duct 204 and deliver the conditioned air to supply duct 202. Conditioning air may involve increasing the temperature of the air, decreasing the temperature of the air, cleaning the air, or other such processes. Thermostat 206 senses the temperature in conditioned space 200 and activates conditioning device 208 when the temperature deviates from a set value. When conditioning device 208 is activated, conditioned air is supplied through supply duct 202 to adjust the temperature of conditioned space 200 until the temperature sensed by thermostat 206 satisfies a set value.

FIG. 2 also shows a typical installation of humidifier 20. Humidifier 20 is installed on supply duct 202 downstream of conditioning device 208. A humidistat 210 is installed in conditioned space 200 and is in communication with humidifier 20. Humidistat 210 senses the humidity level present in conditioned space 200 and activates humidifier 20 when the humidity level falls below a set value. When humidifier 20 is activated, humidity is added to conditioned air within supply duct 202 in order to increase the humidity in conditioned space 200. In some embodiments, humidifier 20 and/or humidistat 210 are configured to activate humidifier 20 only when conditioning device 208 is activated. This ensures that air is flowing through supply duct 202 to carry the additional humidity to conditioned space 200. If humidifier 20 is activated without air flowing in supply duct 202, the additional humidity provided by the humidifier may condense on the walls of the duct and cause damage, and the additional humidity will also not be effectively delivered to conditioned space 200.

In operation of humidifier 20, when there is a call for humidification, humidifier 20 is filled by opening fill valve 42 to allow water from supply 46 to flow through conduit 54 into main chamber 30 of tank 22 and to isolated chamber 26. Fill valve 42 will remain open until water is detected at high water sensor 34, at which point fill valve 42 is closed. In some embodiments, humidifier 20 is filled with water after being installed or activated, in which case the tank 22 is full of water immediately prior to receiving a call for humidification. Heating coil 24 is then energized, causing the temperature of the water in tank 22 to increase in temperature. At some point, the water in tank 22 will begin to boil and steam will form at the top 50 of tank 22. A very slight pressure will be established in the top area 50 of tank 22, typically less than 5 psi, driving steam through steam tube 38 and into duct 40. Steam tube 38 is configured to allow sufficient steam to flow into duct 40 that very little pressure will build in tank 22. The steam enters the air in duct 40 where it is carried to conditioned spaces within a building. As water is converted to steam, the water level in tank 22 will decrease. With sufficient operation, the water level will drop below the height of low water sensor 36. As long as there is still a demand for humidification, when water is below the height of low level sensor 36, fill valve 42 will be opened and remain open until water is again present at high level sensor 34.

Figure 3:
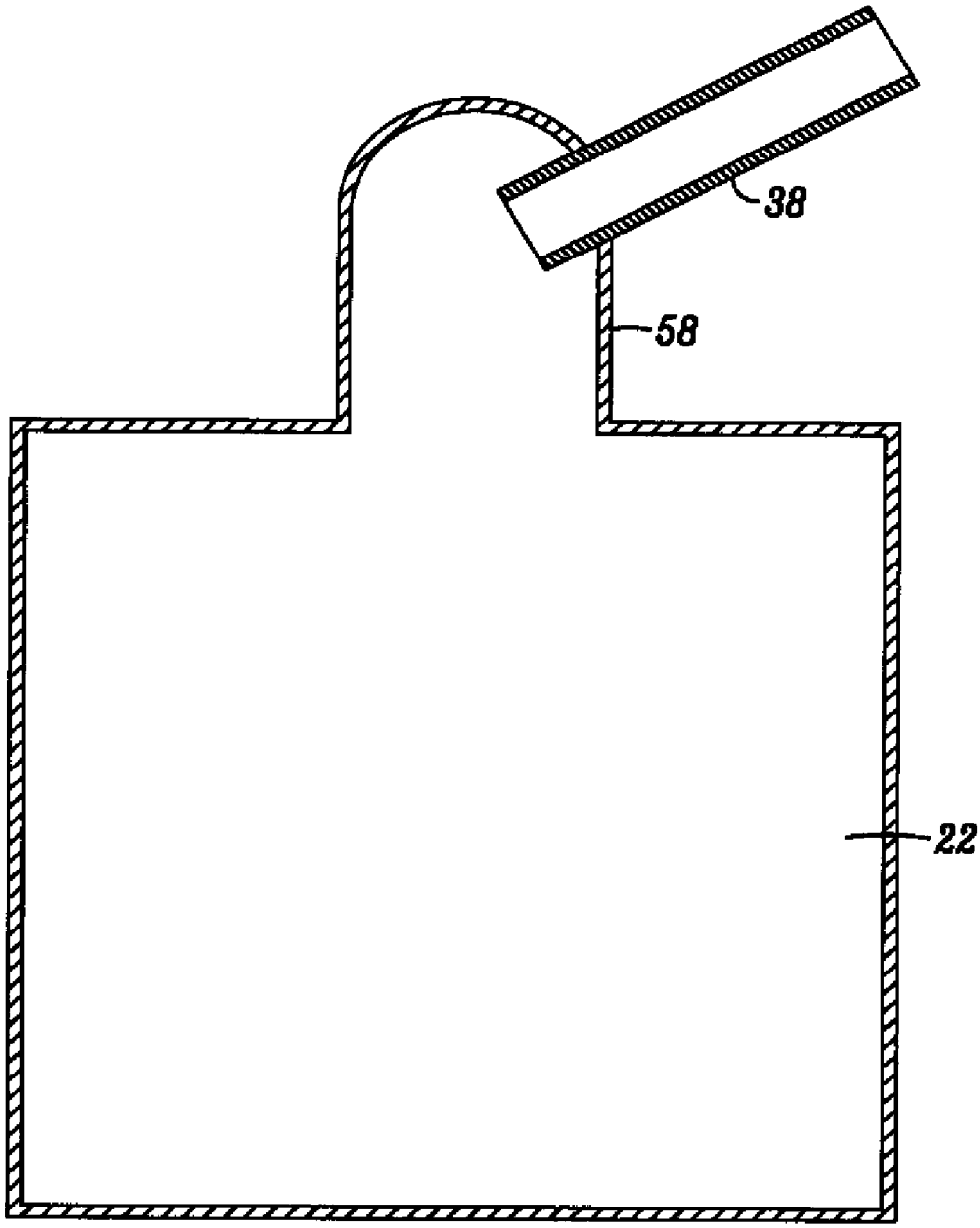
FIG. 3 is a cross-sectional view of a tank heat type steam humidifier having a steam tube and a dome.
Figure 4:
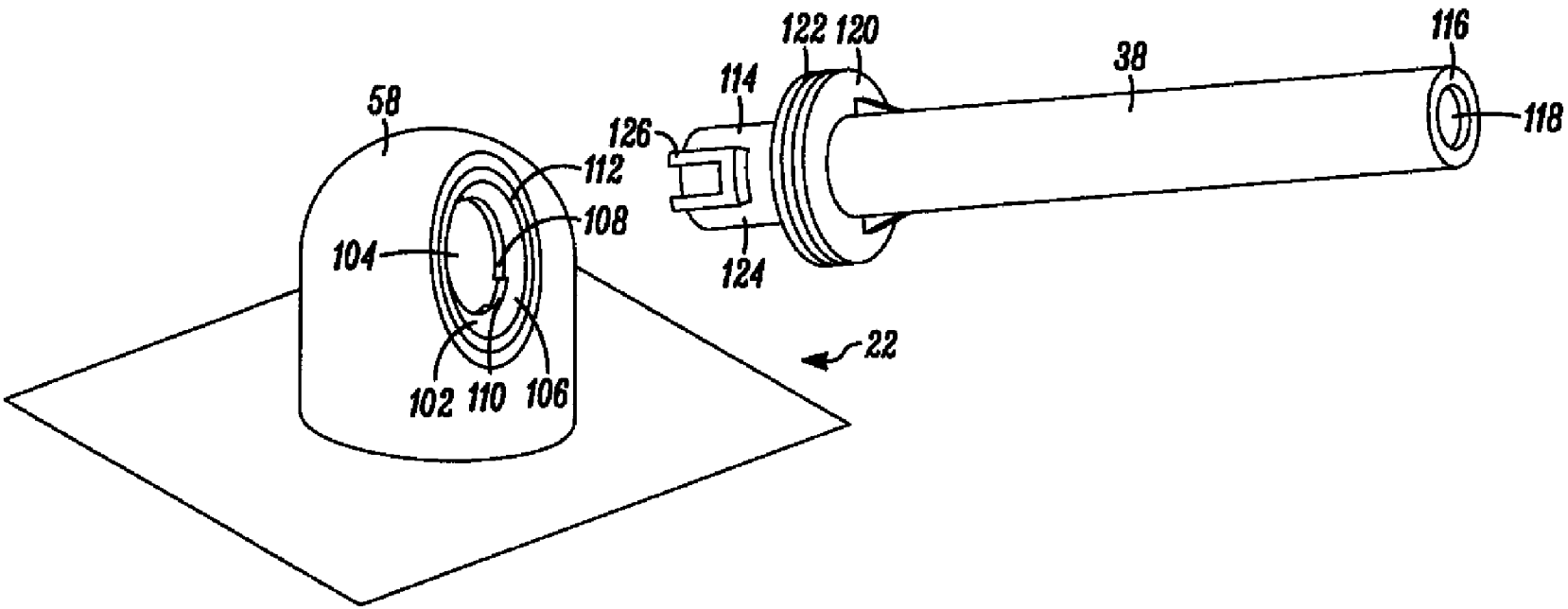
FIG. 4 is an exploded perspective view of a steam tube and a steam tube receiver.
Figure 5:
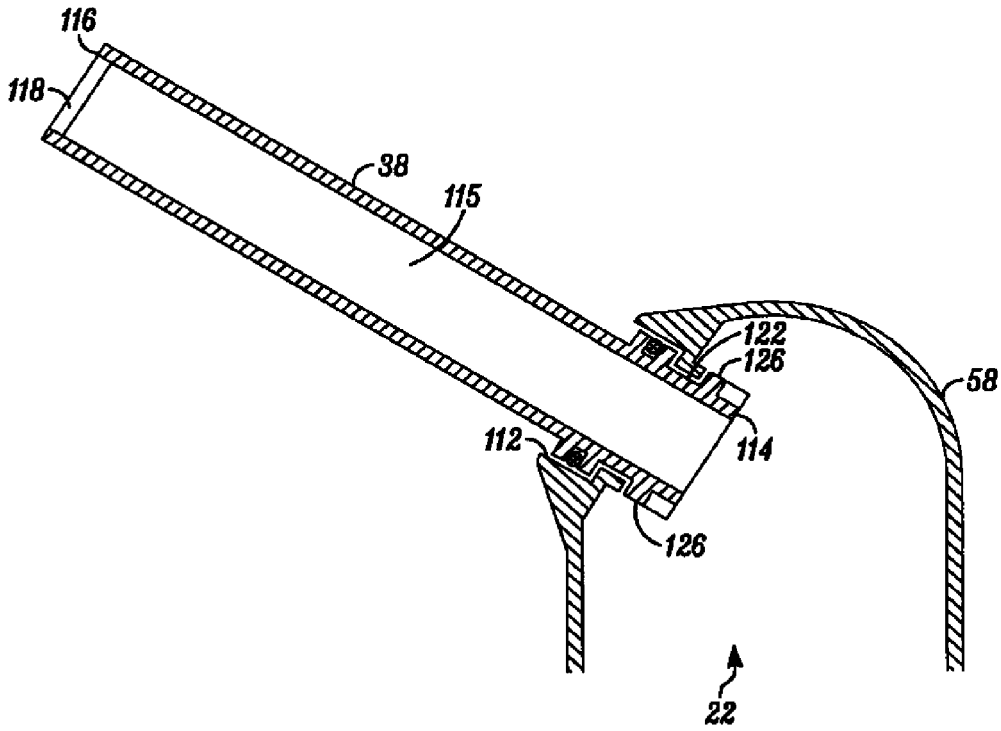
FIG. 5 is a cross-sectional view of a steam tube mounted in a steam tube receiver.
Figure 6:
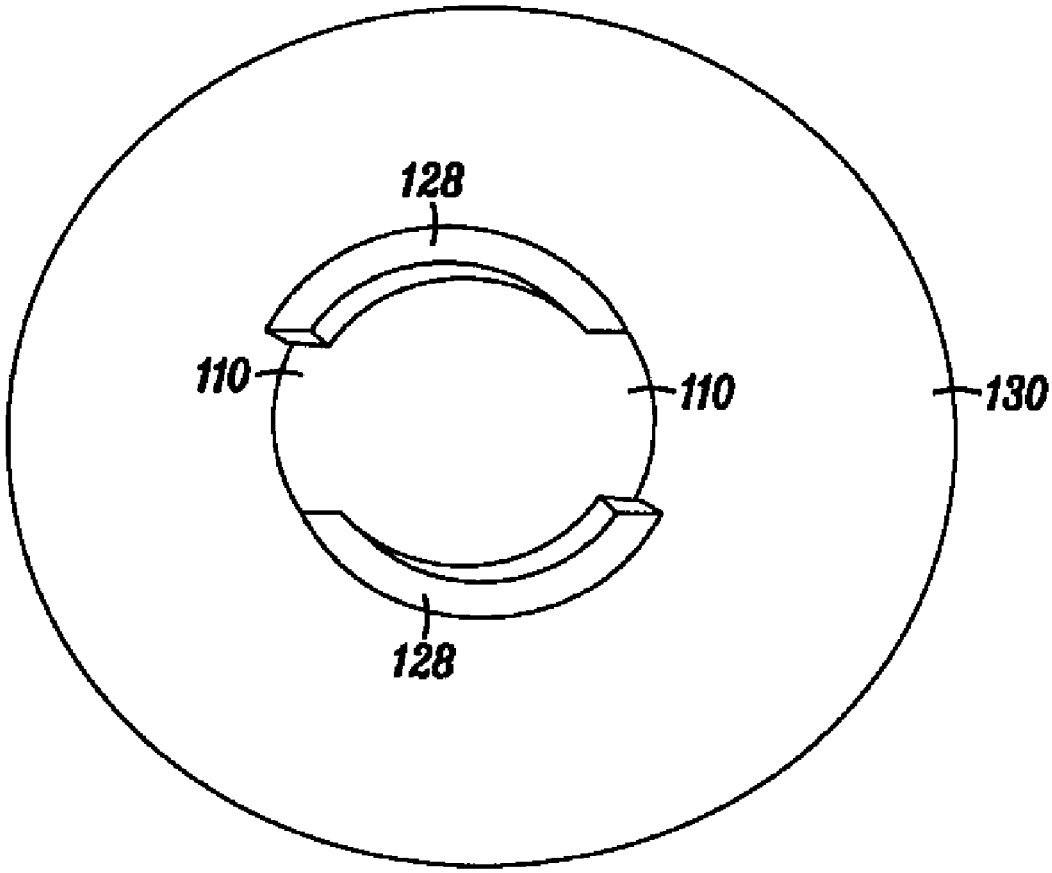
FIG. 6 is a view of an underside surface of a steam tube receiver.
Figure 7:
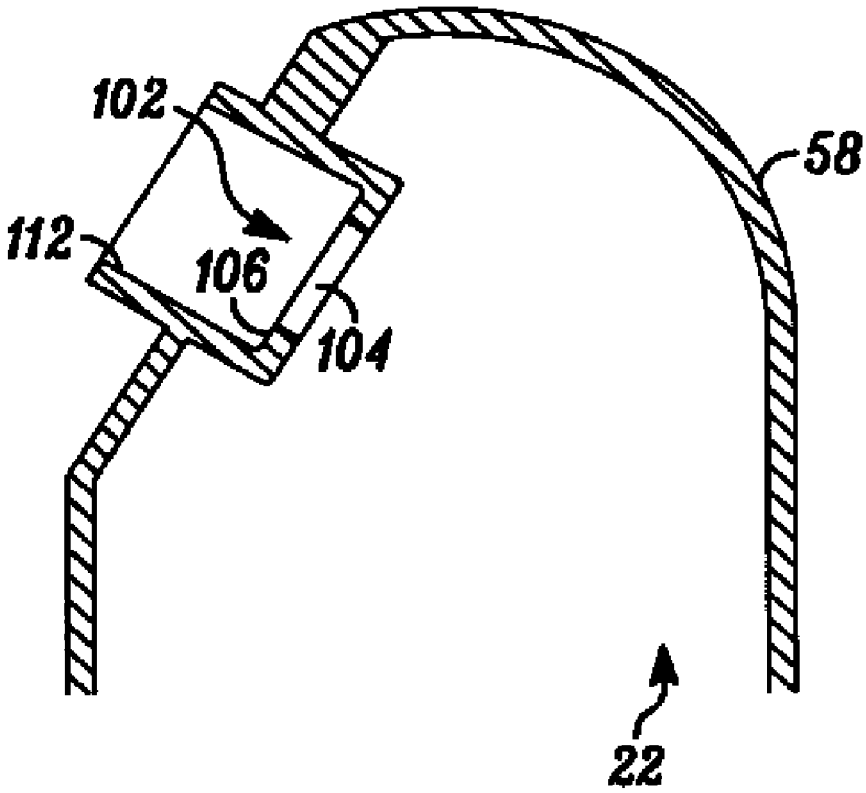
FIG. 7 is a cross-sectional view of a steam tube receiver.
Figure 8:
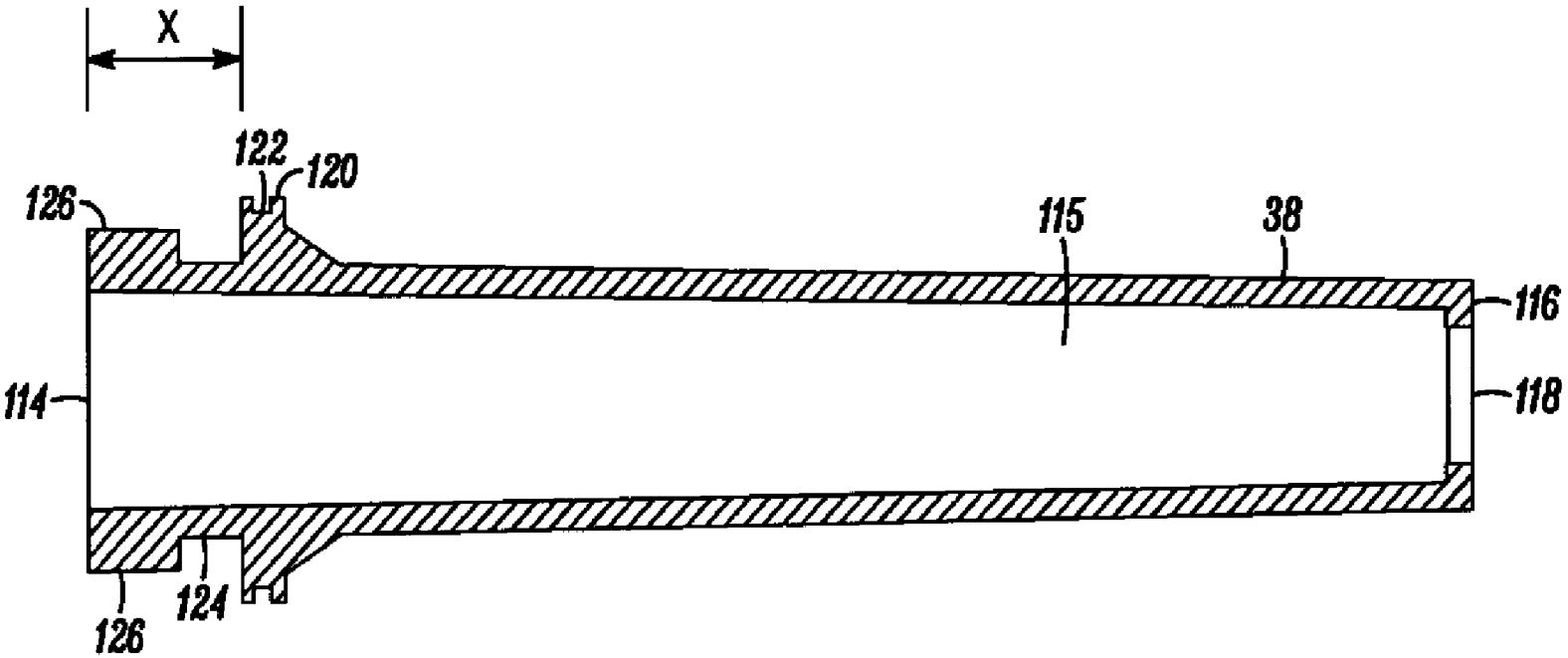
FIG. 8 is a cross-sectional view of a steam tube.

An alternative arrangement of tank 22 and steam tube 38 is shown in FIG. 3. The embodiment shown in FIG. 3 further includes dome 58 located between the water tank 22 and steam tube 38. Dome 58 provides a region for transitioning and directing steam from the water interface to the steam tube 38. By increasing the distance between the water in tank 22 and the steam tube 38, dome 58 helps to prevent liquid water from tank 22 from splashing into steam tube 38, and also helps to prevent any foam that forms at the water surface from entering steam tube 38. Dome 58 also has a relatively large cross-sectional area relative to steam tube 38, such that the steam has relatively low velocity within dome 58 as it travels to steam tube 38. Maintaining a relatively low steam velocity in dome 58 also helps to prevent liquid water from being entrained within the steam and carried from tank 22 into steam tube 38.

As mentioned above, a tank heater type humidifier has a steam tube such as steam tube 38 to deliver steam from the tank 22 to the interior of a duct. Because the steam tube projects from the tank to the interior of the duct, the steam tube often defines the outer profile of the humidifier. However, for purposes of packaging and shipping a humidifier to deliver it to the installation site, it is desired that the humidifier outer profile be as small as possible so that it can fit in as small of a package as possible, such as a box. One way to reduce the outer profile of the humidifier is to remove the steam tube and include it separately within the humidifier packaging. This will require the person who installs the humidifier to assemble the steam tube to the humidifier. It is therefore desired that the steam tube be relatively easy to assemble to the humidifier, and to assemble in such a way that the assembly procedure does not require special tools or complicated procedures that require detailed explanation, experience, or training to accomplish. It is also desired that the connection of the steam tube to the humidifier be robust, such that the connection is not prone to loosening, falling out, or leaking steam based on variations in the installation technique or with usage of the humidifier. Furthermore, it is desired that the components of the humidifier be inexpensive to manufacture, such as by being able to be injection molded, and with as few pieces as possible.

An embodiment of a steam tube 38 and the associated steam tube receiver structure 102 constructed according to the principles of the present invention is depicted in FIGS. 4 to 10. The steam tube receiver structure 102 is shown incorporated into dome 58, however, it could readily be incorporated directly into tank 22 or could have some other arrangement that provides for communication of steam from tank 22 to steam tube 38. A cross-section of the steam tube receiver structure 102 is also shown alone in FIG. 7. Receiver structure 102 includes a steam opening 104 for allowing the passage of steam and for receiving steam tube 38. Steam opening 104 is defined on a face 106, and steam opening 104 consists of a generally round opening 108 and notch openings 110 (seen in FIG. 4). Face 106 further defines the bottom of a cylindrical cavity 112.

Steam tube 38 is shown in FIGS. 4, 5, 8, 9, 10, and 11. Steam tube 38 has a proximal end 114 and a distal end 116, where steam generally flows through cylindrical cavity 115 from the proximal end 114 of the steam tube 38 to the distal end 116 of the steam tube 38, where it is discharged through end opening 118 such as to the interior of a duct. In some embodiments, steam is discharged from a distal end of steam tube 38 to a flexible conduit such as flexible tubing that is configured to deliver the steam to a remote location, such as a duct that is located a distance away from the humidifier. Nearer to the proximal end 114 is defined a flange 120, where flange 120 is located at a distance "x" from the proximal end 114 of steam tube 38. A cylindrical surface 124 is located between the side of flange 120 that faces proximal end 114 of steam tube 38. Flange 120 has an outer diameter that is configured to enter into cylindrical cavity 112. In some embodiments, flange 120 has a seal groove 122, such as an o-ring groove, around the outer perimeter that is configured to receive a seal such as an o-ring that seals against cylindrical cavity 112. Cylindrical surface 124 has an outer diameter that is configured to pass through the generally round opening 108 in face 106.

Figure 11:
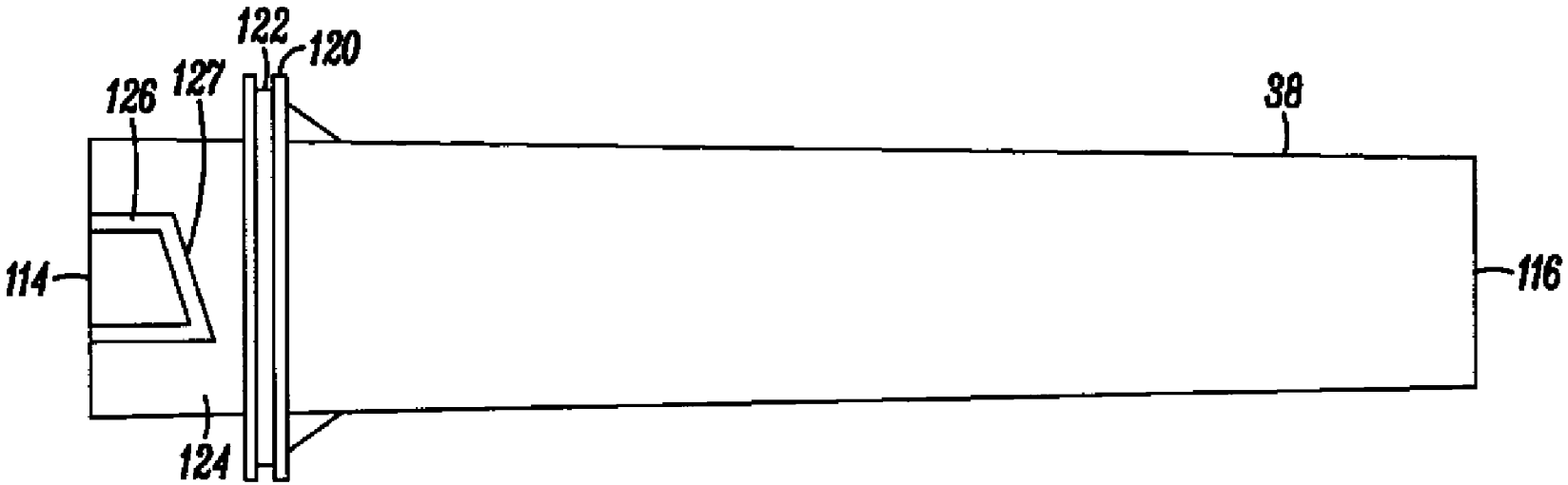
FIG. 11 is a side perspective view of a steam tube.

One or more locking tab features 126 are located on, and protrude from, cylindrical surface 124. Often, locking tab features 126 are provided in a pair, with each locking tab feature on opposite sides of the steam tube from each other. A side sectional view of an embodiment of locking tab features 126 is visible in FIG. 8, and a side perspective view of an embodiment of locking tab features 126 is visible in FIG. 11. Locking tab features 126 are configured to pass through notch openings 110 in face 106 and to engage with ramps 128 located on the underside 130 of face 106. Ramps 128 are visible in FIG. 6. During assembly of steam tube 38 to receiver structure 102, locking tab features 126 pass through notch openings 110 and then steam tube 38 is rotated in the appropriate direction (counter-clockwise as viewed from the perspective of FIG. 6). The rotation of steam tube 38 causes locking tab features 126 to ride up along ramps 128 and to pull steam tube 38 further into cylindrical cavity 112 until flange 120 contacts face 106. As seen in FIG. 11, in one embodiment locking tab features 126 have a generally helical surface 127 that is configured to mate with a generally helical surface of ramps 128. In some embodiments, surfaces 126, 127 are angled with respect to a plane that is perpendicular to an axis through steam tube 38 or opening 108, respectively, and in some embodiments surfaces 126, 127 are generally spiral surfaces. When steam tube 38 is rotated and locking tab features 126 ride up along ramps 128, sufficient friction exists between locking tab features 126 and ramps 128 to prevent locking tab features 126 from backing down ramps 128, which would tend to cause the steam tube 38 to loosen and for flange 120 to move away from face 106. In some embodiments, friction may also be provided between a seal within a seal groove 122 and the cylindrical cavity 112 to prevent the steam tube 38 from loosening. In the embodiment of the ramps 128 shown in FIG. 6, steam tube 38 is turned approximately 90 degrees after locking tab features 126 enter through notch openings 110 before flange 120 is in contact with face 106. However, ramps 128 and locking tab features 126 can also be configured to require a greater or lesser angular rotation to cause flange 120 to be in contact with face 106. For example, ramps 128 and locking tab features 126 may be configured to require a rotation of 20 to 180 degrees, or may be configured to require a rotation of less than or equal to 90 degrees, or may be configured to require a rotation of greater than or equal to 90 degrees, or may be configured to require a rotation of at least 45 degrees. In some embodiments, the ramps 128 and locking tab features 126 are configured to require clockwise rotation, and in other embodiments, are configured to require counterclockwise rotation. The connection of the steam tube 38 to the steam tube receiver structure 102 is said to be a twist lock connection by virtue of the twisting motion used to secure the steam tube 38 to the steam tube receiver structure 102.

In some embodiments, ramps 128 are not present. Instead, locking tab features are configured to engage directly with underside 130 of face 106. In such an embodiment, locking tab features 126 will generally not have a helical surface 127, but rather surface 127 will be parallel to the proximal end face 114 of steam tube 38. In use, locking tabs features 126 are inserted through notch openings 110 until flange 120 is in contact with face 106, and then steam tube 38 is rotated. The amount of rotation should be within a range where locking tab features 126 will be engaged with underside 130 and should not be so great that locking tab features 126 align or re-align with notch openings 110. In some embodiments, a stop will be provided on underside 130 to prevent locking tab features 126 from being rotated too far.

In some embodiments, the locking tabs are configured so that they can be created during the molding process in which the steam tube is formed. As a result, the steam tube and the locking tabs are created simultaneously. In some embodiments, no additional parts, processes, or assembly procedures are required to provide the locking tabs on the steam tube. In some embodiments, the steam tube receiver structure and the notch openings and any ramps are formed during a single molding process also. In some embodiments, no additional parts, processes, or assembly procedures are needed to provide the structure on the dome that will provide the locking function to the one or more locking tabs of the steam tube.

Figure 10:
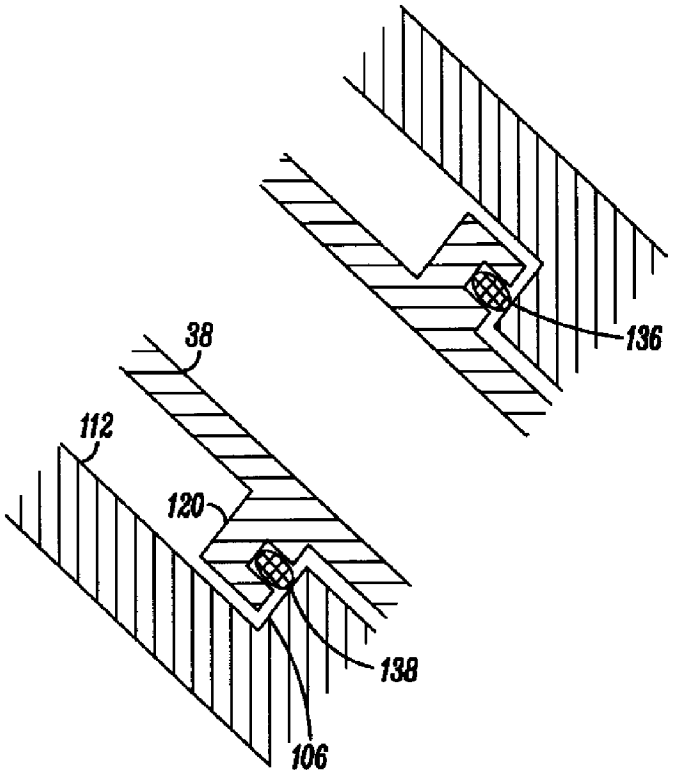
FIG. 10 is a cross-sectional view of an alternative embodiment of a seal between a steam tube and a steam tube receiver.
Figure 9:
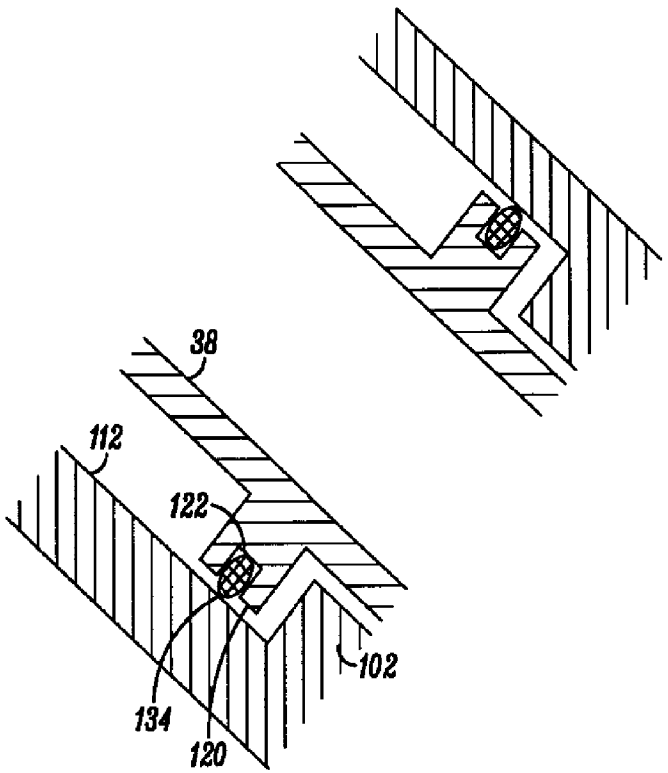
FIG. 9 is a cross-sectional view of a seal between a steam tube and a steam tube receiver.

In some embodiments, there is a seal between the flange 120 of steam tube 38 and a surface of the steam tube receiver structure 102. One embodiment of a seal is shown in FIGS. 4, 5, 8, and 9. In this embodiment, a seal groove 122 is located around the outer perimeter of flange 120, and a seal 134 is placed in groove 122. When steam tube 38 is assembled to steam tube receiver structure 102, seal 134 contacts cylindrical cavity 112 and is compressed slightly to form a low-pressure steam tight seal. Another embodiment of a seal is shown in FIG. 10. In the embodiment of FIG. 10, flange 120 of steam tube 38 has a seal groove 136 located on an underside surface that is positioned against face 106 when steam tube 38 is in an installed position. A seal 138 is placed in seal groove 136, and when steam tube is assembled to steam tube receiver structure 102, seal 138 is pressed against face 106 to form a steam tight seal. In some embodiments, a plurality of seal grooves 122, 136 are provided and used with a plurality of seals 134, 138.

Other embodiments of a sealing arrangement between steam tube 38 and steam tube receiver structure 102 are usable. For example, rather than using an arrangement having a seal groove and a seal, a flange may be provided that is configured to seal tightly with a corresponding feature of steam tube receiver structure 102. In some embodiments, rather than providing a seal groove and a seal, the steam tube flange may be provided with one or more relatively flexible and pliable features that are configured to enter an opening in steam tube receiver structure and to provide a sealing function.

In some embodiments there is a detent present on a locking tab 126, ramp structure 128, or underside 130 of face 106 in order to provide a tactile indication that the steam tube 38 has been rotated to an appropriate position and to prevent the steam tube 38 from rotating out of position in use. In one embodiment, a detent consists of a raised feature on one component that will register with a depressed feature on a corresponding component when the steam tube 38 has been rotated to the appropriate position. For example, a raised feature could be a semi-spherical protrusion on surface 127 of steam tube 38 and a depressed feature could be a semi-spherical depression on ramp structure 128. In this arrangement, there may be a relative increase in frictional interference as the protrusion on surface 127 is rotated along ramp 128, but when the steam tube 38 is rotated the appropriate amount that the protrusion aligns with the depression, the steam tube will tend to snap into place and remain in the appropriate position.

In some embodiments there is a visual indicator that enables a person who is installing steam tube 38 to visually determine whether the steam tube 38 has been rotated sufficiently to properly engage with the steam tube receiver structure 102. For example, there may be a rib or other visually perceptible feature on the steam tube receiver structure 102 and another rib or other visually perceptible feature on the steam tube 38, where the ribs or other visually perceptible features are configured to come generally into alignment when the steam tube 38 has been rotated sufficiently.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A steam humidifier, comprising:

(i) a housing;

(ii) a tank;

(iii) a heater for heating water in the tank to generate steam; and (iv) a steam tube having a fluid passageway defined by rigid walls, wherein the steam tube is releasably securable to the tank by, at least in part, rotating the steam tube relative to the tank, and when secured to the tank, the steam tube extends out from the housing.

2. The steam humidifier of claim 1, wherein the housing includes one or more features for mounting the housing to a duct of an HVAC system such that the steam tube extends out from the housing and into an interior of the duct.

3. The steam humidifier of claim 1, further including a sealing element for providing a fluid tight seal between the steam tube and the tank when the steam tube is releasably secured to the tank.

4. The steam humidifier of claim 1, wherein the steam tube and tank are releasably securable together in the field by hand without any tools.

5. The steam humidifier of claim 1, wherein the tank includes a reduced cross-sectional area on top of the tank, where the steam tube is releasably securable to the reduced cross-sectional area.

6. The steam humidifier of claim 5, wherein the reduced cross-sectional area includes a dome shaped portion.

7. A steam humidifier, comprising:

(i) a tank for heating water to generate steam; and (ii) a steam tube having a fluid passageway defined by rigid walls, the steam tube and the tank being configured to be releasably securable together in the field, wherein the steam tube is securable to the tank by, at least in part, rotating the steam tube relative to the tank and when releasably secured together, the steam tube directs steam from the tank, through the fluid passageway, and towards a duct of an HVAC system.

8. The steam humidifier of claim 7, wherein the steam humidifier includes a housing, and at least part of the steam tube extends out external of the housing when the steam tube is secured to the tank.

9. The steam humidifier of claim 8, wherein the housing includes one or more features for mounting the housing to a duct such that the steam tube extends out from the housing and into an interior of the duct.

10. The steam humidifier of claim 7, further including a sealing element for providing a fluid tight seal between the steam tube and the tank when the steam tube is releasably secured to the tank.

11. The steam humidifier of claim 7, wherein the steam tube and tank are releasably securable together in the field by hand without any tools.

12. The steam humidifier of claim 7, wherein the tank includes a reduced cross-sectional area on top of the tank, where the steam tube is releasably securable to the reduced cross-sectional area.

13. The steam humidifier of claim 12, wherein the reduced cross-sectional area includes a dome shaped portion.

14. A method of assembling a steam humidifier, the method comprising:

(i) obtaining a steam tube having a fluid passageway defined by rigid walls;

(ii) obtaining a tank for heating water to generate steam, the tank including a steam tube receiver, the steam tube and the tank being configured to be rotatably securable together in the field;

(iii) aligning the steam tube with the steam tube receiver of the tank; and (iv) rotating the steam tube relative to the steam tube receiver to releasably secure the steam tube relative to the tank such that when secured together, the steam tube directs steam from the tank, through the fluid passageway, and towards a duct of an HVAC system.

15. The method of claim 14, further comprising mounting the steam humidifier to a duct of an HVAC system.

16. The method of claim 15, further comprising cutting a hole in the duct of the HVAC system to receive the steam tube before mounting the steam humidifier to a duct of the HVAC system.

17. The method of claim 16, further comprising inserting the steam tube though the hole in the duct of the HVAC system when mounting the steam humidifier to the duct.

18. The method of claim 17, further comprising activating the steam humidifier to produce steam.

19. The method of claim 14, further comprising rotating the steam tube relative to the steam tube receiver to release the steam tube from the tank.

* * * * *